United States Patent [19]

Cranberg

[11] 4,090,086

[45] May 16, 1978

[54] METHOD AND APPARATUS FOR GENERATING NEUTRONS

[75] Inventor: Lawrence Cranberg, Travis County, Tex.

[73] Assignee: TDN, Inc., Austin, Tex.

[21] Appl. No.: 452,080

[22] Filed: Mar. 18, 1974

[51] Int. Cl.[2] ..... G21G 3/04

[52] U.S. Cl. ..... 250/499; 250/282; 250/500

[58] Field of Search ..... 250/281, 282, 499, 500, 250/501, 502, 298

[56] References Cited

U.S. PATENT DOCUMENTS

| | | | |
|---|---|---|---|
| 2,576,600 | 11/1951 | Hanson | 250/499 X |
| 3,268,730 | 8/1966 | Van de Graaff | 250/502 X |
| 3,657,542 | 4/1972 | Futch, Jr. et al. | 250/500 |
| 3,733,490 | 5/1973 | Roche | 250/501 |

OTHER PUBLICATIONS

*Rotating Neutron Target System*, by Booth et al., Feb. 27, 1967, Lawrence Radiation Lab., Publication UCRL-70183.

*Tritium Target For Intense Neutron Source*, by Booth et al., Nov. 3, 1971, *Lawrence Radiation Lab.*, Publication UCRL-73525.

*Target Tech. For Medium and High-Power Applications*, by Cossulta, Mar. 23-25, 1970, Proc. at Dak Ridge, Publ. CONF-700322, pp. 431-439.

*Primary Examiner*—Davis L. Willis

*Attorney, Agent, or Firm*—Vinson, Elkins, Searls, Connally & Smith

[57] ABSTRACT

An apparatus and method for generating high-energy neutrons are disclosed. Neutron emissive target material is deposited on one or more surfaces on a rotatable, hollow, toroidal target support. Said surfaces are bombarded by beams of ions of generally rectangular cross section, so that when the bombarded surfaces are viewed end-wise, a compact, generally square source of neutrons is provided, such as is required for collimation. A combination of molecular and atomic ions emitted from at least one conventional accelerator are passed through a magnetic field for the purpose of separating the ions into one homogeneous group of atomic and one homogeneous group of molecular ions before said ions are allowed to impinge on the target surfaces. One accelerator directs ions to each target surface as the target rotates. Coolant is directed through a cavity within the toroidal support for the purpose of cooling the target support and target material. A refrigerated surface is placed in close proximity to the target surface to condense vapors which might prove harmful to the target and for thermally cooling said target.

29 Claims, 5 Drawing Figures

10
12
14
16
18
20
22
23
24
26
28
30
32
34
36
38
40
42
44
46
47
48
49
50
54
56
56a
56b
58
58a
58b
60
62
64
66
68
70a
70b
71
72
73
74
76
78
86
88
89
90
91
92
93
94
95
98
99a
99b
100a
100b
101
102
103
104
106
108
110
112
113
114
115
116
117
118
119
121
2
3

METHOD AND APPARATUS FOR GENERATING NEUTRONS

BACKGROUND OF THE INVENTION

1. Field

This invention relates to an apparatus and method for generating high-energy neutrons. The invention particularly relates to a neutron generating target apparatus and method for producing a high flux of high-energy neutrons.

2. Prior Art

High-energy neutrons may be generated by the $T(d,n)He^4$ reaction which is well known to the skilled artisan as the D-T reaction. This reaction is typically produced by causing deuterium ions from an accelerator to impinge on a titanium target which is impregnated with tritium. As the deuterium ions bombard the tritiated target, neutrons are emitted at the rate of approximately one for every $10^5$ ions impinging on the target.

As ions contact the target in the D-T reaction, almost all of the kinetic energy of said ions is transformed into thermal energy therein. If the temperature of the neutron emitting tritiated target is allowed to exceed a few hundred degrees Centigrade, the tritium diffuses out of the target, thus impairing the neutron-producing efficiency of the target and decreasing its useful life. Thus, cooling of the target material becomes critical to prolonging the life of the target. The cooling problem in the D-T reaction is aggravated by the fact that the target material is typically a poor conductor of heat and that the side of the target material in which the energy is deposited is in a vacuum.

Another factor which limits the flux and reduces the lifetime of targets which use the D-T reaction is what might be called the "dilution effect". This is the effect of cumulative implantation of projectile ions into the target during bombardment, whereby these implanted ions dilute, and eventually displace the target atoms, thereby diminishing the yield of the target.

In the prior art, stationary and geometrically flat targets have been used as neutron sources. These neutron sources have generally short lives as a result of rapid deterioration due to overheating and dilution of the target. Recently, methods for utilizing dynamic targets have been disclosed with reported success. For example, see Booth, R. "Rotating Neutron Target System" UCRL-70183, University of California Radiation Laboratory, February 1967; Booth, R. and Barschall, H., "Tritium Target for Intense Neutron Source," UCRL-73525, University of California Lawrence Radiation Laboratory, November 1971, which disclose rotating, water-cooled targets which yield approximately 2 times $10^{12}$ neutrons per second at the source for a lifetime in excess of 100 hours, using a 400 KEV beam of deuterons (atomic deuterium ions) of 8 milliamperes or 3200 watts. See also D. D. Cossuta, "Target Technology for Medium and High-Power Applications," Proceedings of the Second Oak Ridge Conference on the Use of Small Accelerators for Teaching and Research, Mar. 23-25, 1970, CONF-700322.

The use of high-energy neutrons in the irradiation of cancers is finding increasing acceptance as an effective therapeutic technique. The theoretical and clinical work performed to date indicate strongly the need for a collimated beam of neutrons of about 14 MEV at an intensity or flux level at the neutron source, assuming isotropic emission, of at least 4 times $10^{12}$ neutrons per second, for a target lifetime in excess of 100 hours, in order to provide effective therapeutic irradiation of a patient situated at a distance of about one meter from the neutron source. Thus, even the improved targets of Booth and Barschall do not provide a sufficiently high intensity neutron source for cancer therapy and other high neutron intensity applications.

In applicant's copending application "Neutron Generator Target Assembly", Ser. No. 286,402, filed Sept. 5, 1972, now U.S. Pat. No. 3,860,827, which is incorporated herein by reference, it is shown that in applications of neutron generators to the production of a collimated beam of neutrons, as required for cancer therapy, it is useful to have a neutron source area which is not circular or square, as in the target apparatus in the references of Booth, Barschall and Cossuta, but is elongated in the direction in which neutrons produced in the target are designed to be emitted from the target apparatus. In applications using a neutron collimator, the desired elongation is in the direction substantially along the axis of the neutron collimator. Such elongation results in increasing the area on which the ion beam impinges, thereby diminishing the heat load per unit area of the target and reducing the dilution effect. Further, an elongated neutron source does not impair the quality of the collimated beam. The prior art has shown that effective collimation can be achieved with a source of neutrons whose area, projected on a plane perpendicular to the axis of collimation, does not exceed 2 cm by 2 cm. This requirement can be achieved with a source viewed end-wise of generally rectangular area whose width is considerably greater than 2 cm. Applicant in his copending application Ser. No. 286,402 sought to utilize this feature. However, the neutron source was elongated in directions which were parallel or anti-parallel to the direction of the ion beam as well as the collimator axis. This arrangement required that neutrons pass through the target support and coolant on their way to the patient, causing scattering and absorption of said neutrons, thereby diminishing the efficiency of neutron transmission. Also, in anti-parallel emission, means are required to avoid scattering of neutrons by the accelerator itself. These means complicate the problem of effectively collimating the neutron beam in the direction of the patient.

As used in the description and claims herein the long dimension of the generally rectangular neutron source shall be referred to as the width of the source and the other dimension as the height.

The prior art has shown that the useful life of a target can be prolonged by having impinging ions of a single mass species. See, for example, Booth and Barschall cited above. They have noted that the ion sources commonly used in accelerators produce both atomic ($D^+$) and molecular ($D_2^+$) ions, often in comparable quantities, and that the shorter range $D_2^+$ ions are implanted in the target at depths which dilute the target atoms for the $D^+$ ions. In the prior art, the molecular ions have been sorted out and discarded, thus leaving the atomic ions alone as the one species of target-bombarding particles. The prior art method for discarding unwanted ions includes the use of mass analysis in the high voltage terminal of the accelerator so that the unwanted ions would not present a problem after emission from the accelerator. The above method is known in the art as "terminal analysis" and is considered to be a problem since it is expensive and degrades the quality of the ion beam which is selected for acceleration. Also, the combination of molecular and atomic ions produced by conventional ion sources is used inefficiently in known methods since all ions are not used to bombard the target in order to cause neutron generation.

Other prior art references which are of a more general interest are U.S. Pat. No. 2,251,190 to Kallmann, U.S. Pat. No. 2,929,933 to Ela et al., U.S. Pat. No. 2,712,081 to Feason et al., U.S. Pat. No. 2,943,239 to Goodman, U.S. Pat. No. 3,311,769 to Schmidllein, and U.S. Pat. No. 2,576,600 to Hanson.

SUMMARY

Applicant solves the problem of producing a long-lived high-intensity source of high-energy neutrons by providing a rotating, toroidal target support having at least one external surface on which the target material is deposited. As the toroidal target support is rotated, one beam of particles which causes neutrons to be emitted from the target material is directed to each target surface. The bombardment of each beam of particles produces a neutron flux of approximately 2 times $10^{12}$ neutrons per second, and thus a combination of two beams of equal intensity bombarding two surfaces produces a neutron flux of approximately 4 times $10^{12}$ neutrons per second.

Applicant solves the problem of producing an intense beam of well-collimated 14-MEV neutrons from a long-lived source by providing a source of neutrons having substantially rectangular cross section whose width lies on the generatrix of the frustum of a generally conical surface which, during operation, is in continuous rotation about the axis of the cone.

Applicant solves the problem of retaining the target material below a temperature at which the neutron producing efficiency is impaired by providing a hollow, toroidal target support having a property of a high thermal conductivity. Coolant is forced through the channel within the target support to remove heat from the target and target support. A partition wall or walls within the target support channel divides input and output coolant passageways to insure that the coolant travels through the target support for not more than one revolution before being directed from the channel.

Applicant solves the problem of using both atomic and molecular ions for bombarding a single target by passing the combination of ions through a magnetic field after emission from an accelerator to separate the ions into groups of ions of a single mass species before said ions impinge on the target. This system of post-acceleration mass-analysis is inexpensive to design and manufacture and provides for an efficient and reliable use of ions from an accelerator.

Thus, it is an object of the present invention to produce a high flux of neutrons.

Another object of this invention is to provide an apparatus which produces neutrons emitted over all solid angle in excess of 4 times $10^{12}$ per second.

Another object of the invention is to provide an apparatus which increases the lifetime of a neutron emissive target.

Another object of the invention is to provide an apparatus for efficiently cooling the neutron emissive target material.

Another object of the invention is to provide a new geometry target support for use with a plurality of particle beams from a single accelerator.

Another object of the invention is to provide a target of such geometry that simultaneous bombardment of said target with particles from two accelerators will produce a high flux of neutrons from what is effectively a single source which may be collimated to deliver a single, intense beam of neutrons.

Another object of the invention is to increase the lifetime of the target material under particle bombardment by spreading the particle beam over an extended target area, while providing a source of neutrons sufficiently compact so that neutrons produced by the source may be effectively collimated.

Another object of the invention is to provide a controlled flow of coolant through a hollow target support to prevent trapping or stagnation of hot coolant.

Another object of the invention is to provide a neutron emissive target with high neutron transmission efficiency.

Another object of the invention is to substantially reduce the temperature and dilution of the target by rotating the target such that the ion beam is spread over an extended area of target material.

Another object of the invention is to prolong the life of the target by separating by magnetic means the molecular and atomic ions in the ion beam so that only ions of a single mass species impinge on a defined area of the target.

A further object of the invention is to provide an apparatus for efficiently utilizing both atomic and molecular ion beams to bombard a target.

A further object of the invention is to provide a neutron generator apparatus having means for preventing deposits of carbon on the taget material while simultaneously cooling the target material.

BRIEF DESCRIPTION OF THE DRAWINGS

The foregoing and other objects, features, and advantages of the invention will be apparent from the following more particular description of a preferred embodiment of the invention as illustrated in the accompanying drawings wherein like reference numerals indicate like parts in which.

DESCRIPTION OF THE PREFERRED EMBODIMENTS

Figure 1:
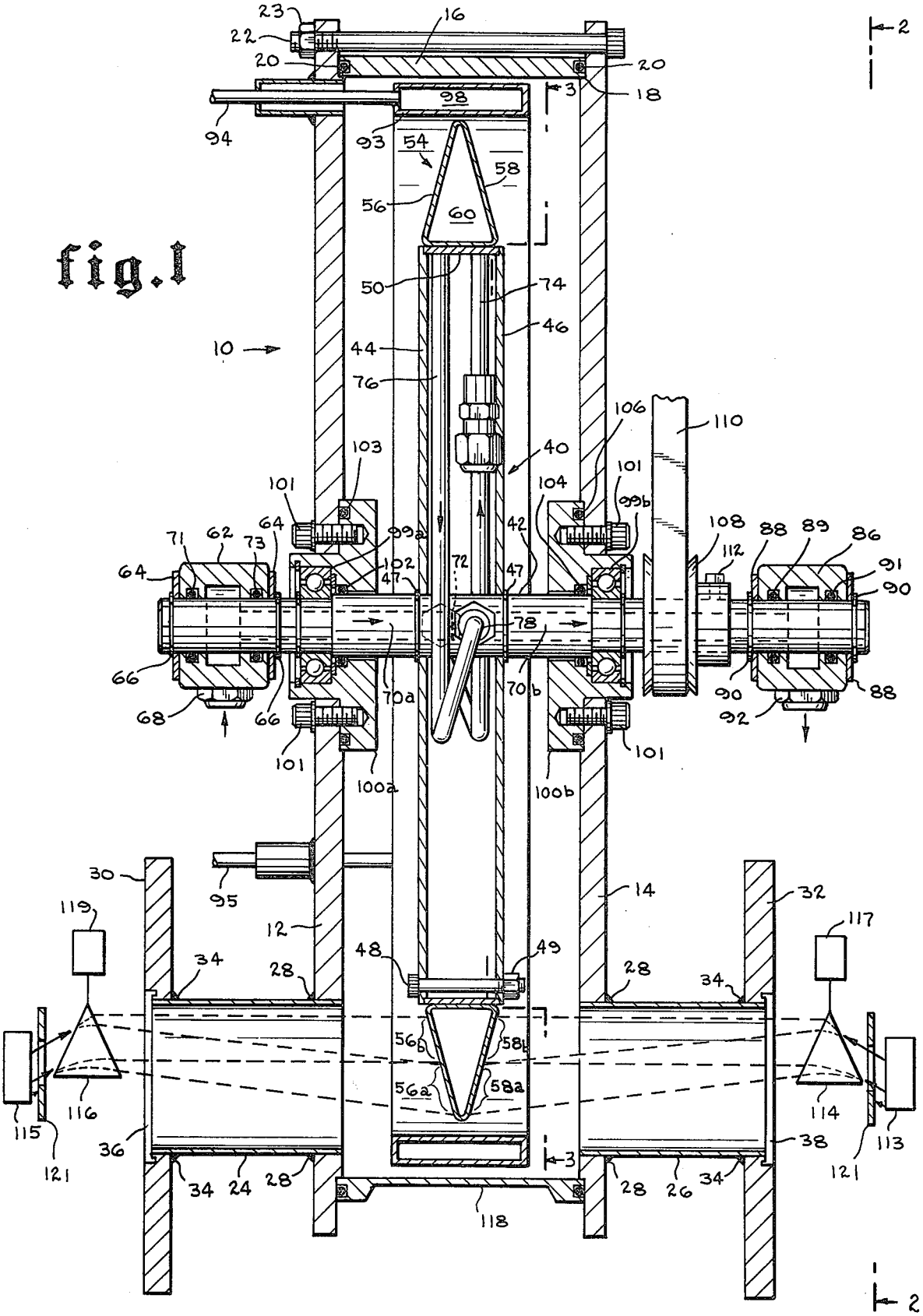
FIG. 1 is a partial sectional view of the preferred embodiment of the target apparatus.
Figure 2:
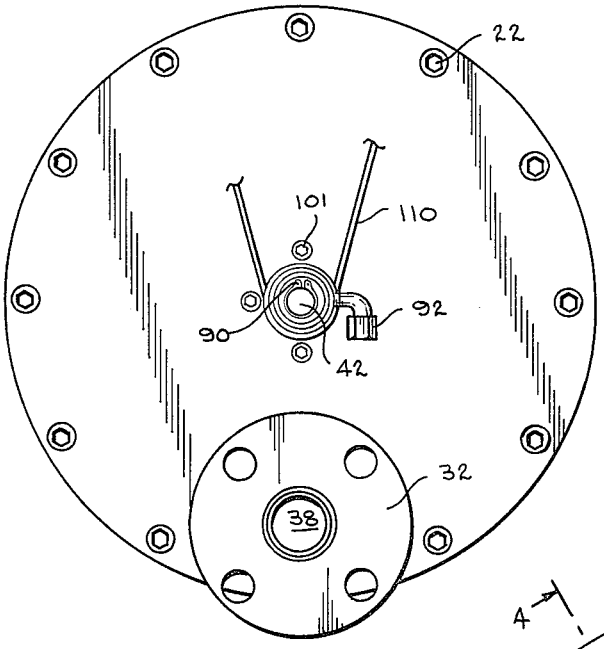
FIG. 2 is a view taken along line 2—2 in FIG. 1.
Figure 3:
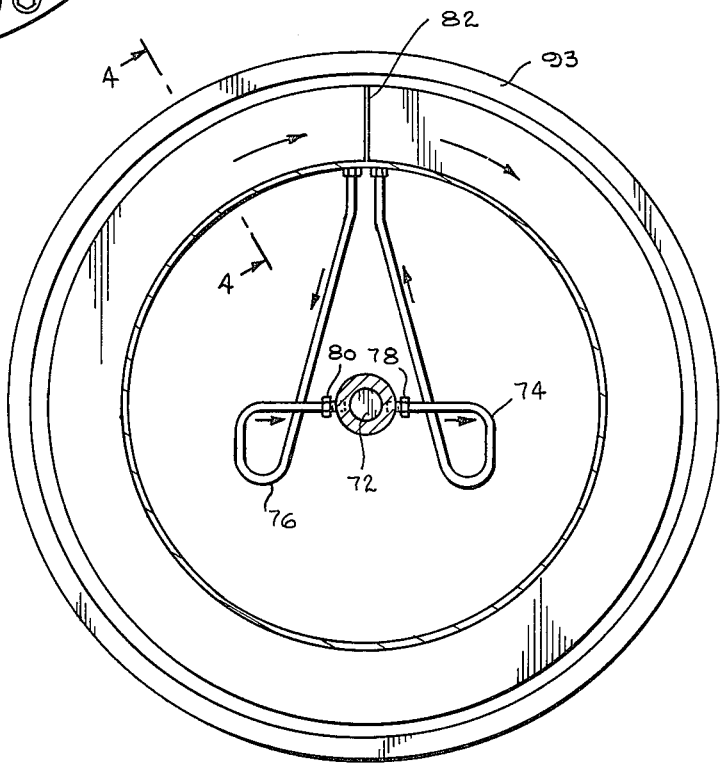
FIG. 3 is a view taken along line 3—3 in FIG. 1.
Figure 4:
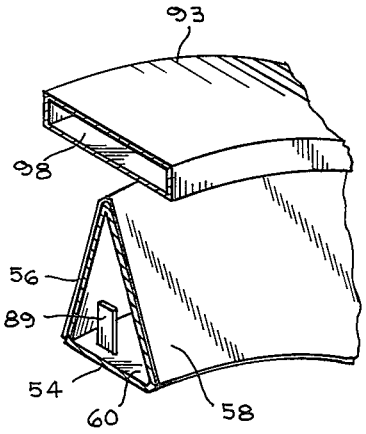
FIG. 4 is a view taken along line 4—4 in FIG. 3.

Referring to FIG. 1, a neutron generator target apparatus is shown in accordance with the present invention. A housing 10 for the target apparatus comprises two circular walls 12 and 14 which are spatially supported by ring 16 which extends circumferentially around the walls 12 and 14 in recesses 18 in a flush manner such that walls 12 and 14 are parallel to each other. O-rings 20 or other suitable sealing means provide for a vacuum seal between walls 12 and 14 and ring 16. Ring 16 and walls 12 and 14 may be made of stainless steel. Ring 16 is secured in vacuum tight position by threaded bolts 22 which pass through suitable receiving apertures in walls 12 and 14 and are held in place by nuts 23.

Two circular coaxial ports 24 and 26 are provided in walls 12 and 14 of the housing and are connected thereto by circular welds 28 or other suitable means for insuring a secure and vacuum tight connection. Ports 24 and 26 have circular, coaxial flanges 30 and 32, respectively, which are secured thereto by weld 34 or other suitable means. Flanges 30 and 32 define circular windows 36 and 38, respectively, through which ions or other particles may be projected by accelerators or other particle generators which are located external to the target housing. The flanged ports 24 and 26 are suitable for a vacuum-tight connection to a source of ions in accelerators (not shown).

The target support and cooling assembly 40 is supported by a hollow shaft 42 which is suitably mounted for axial rotation within target housing 10. Two circular plates 44 and 46, which may be made of stainless steel, have circular apertures through which coaxial shaft 42 may pass so that plates 44 and 46 may be mounted on shaft 42. Retaining rings 47 prevent plates 44 and 46 from moving axially with respect to shaft 42. Ring 50 is located circumferentially around the perimeter of plates 44 and 46 and held in place by threaded bolts 48 which passes through suitable receiving apertures in plates 44 and 46 and held in place by nuts 49. The plates 44 and 46 and ring 50 define an enclosure for the coolant tubes to be discussed more fully hereinafter. Walls 12 and 14, plates 44 and 46, and shaft 42 are all coaxial.

Mounted on ring 50 by weld or other suitable means is a toroidal figure which serves as a target support. In the preferred embodiment, the target support 54 is an isosceles toroid which is composed of a substance having a property of high thermal conductivity such as copper or zircalloy. The axis of the toroid support is coaxial with shaft 42. The target support 54 has two thin-walled sides whose external surfaces 56 and 58 are frusta of coaxial cones on which a neutron emissive substance such as tritiated titanium is deposited by methods which are well knowm. In the preferred embodiment, the length of surfaces 56 and 58 along a generatrix is about 2 inches. The neutron-emissive substance is the target for the ion beam and the thickness of the target in the preferred embodiment is greater than the range of the bombarding ions so that all of the kinetic energy of said ions is deposited in said target.

To prevent overheating of the target material on surfaces 56 and 58 of the target support, coolant is directed through the interior channel or cavity 60 of the target support 54. Coolant enters the system through coolant connector 62 which is supported on shaft 42 for rotational movement with respect thereto by bearing or other suitable means 64 and retaining rings 66. Connector 62 is held substantially fixed with respect to housing 10 by a coolant hose (not shown) which is connected to fixture 68. Coolant is directed to connector 62 under pressure and flows through section **70*a* of hollow axial channel or cavity 70 within shaft 42. O-rings 71 and 73 prevent leakage of coolant from the space between connector 62 and shaft 42. A partition 72 within the shaft 42 divides the coolant channel 70 into two separate sections thereof 70*a* and 70*b* and prevents any flow of coolant from section 70*a* to section 70*b*** directly.

The coolant channels **70*a* and 70*b* are connected to tubes 74 and 76 via suitable fittings 78 and 80, respectively. The fittings 78 and 80 provide a means for coupling the target assembly 40 to the shaft 42 so that they rotate in concert. The tubes 74 and 76 are connected to the target support 54 on opposite sides of a partition 82 and immediately adjacent thereto whereby the partition 82 functions to prevent the flow of coolant through the target support channel at that point. Tube 76 may be referred to as means for transmitting coolant from said shaft channel 70*a* to said support channel 60 and tube 74 may be referred to as means for transmitting coolant from said support channel 60 to said shaft channel 70*b*. Channel 70*a* may be referred to as an input cavity and channel 70*b* as an output cavity. Partition 82 may be referred to herein as a means for controlling the flow of coolant within said support channel 60 so that coolant cannot travel more than one revolution therethrough. In the preferred embodiment partition 82 is made of a thermally insulating material to prevent heat transfer between the two sides thereof. As coolant flows through shaft channel 70*a*, it is directed through tube 74 by shaft partition 72 and into the target support channel 60 adjacent to partition 82. Coolant is then directed by partition 82 through the inside of the target support where it flows circumferentially therein for the purpose of removing heat from the target material which is deposited on target support surfaces 56 and 58. Target support partition 82 forces the coolant out of the target support channel 60 and into tube 76 after the coolant has traveled completely through the target support channel. A plurality of coolant agitating fins 89 within the target support channel 60 cause turbulence in the flow of coolant therein to prevent trapping of hot coolant against the interior surfaces of the target support 54. Coolant flowing through tube 76 is directed by partition 72 through shaft channel 70*b* to coolant connector 86. Connector 86 is rotatably supported on shaft 42 by bearings 88 or other suitable means and is prevented from axial movement along the shaft by retaining rings 90. O-rings 89 and 91 prevent leakage of coolant from the space between connector 86 and shaft 42. Fixture 92 provides a means for affixing the connector 86 to a coolant hose (not shown) for directing coolant from the target apparatus. When a hose is attached to connector 86, connector 86 is prevented from rotating axially about the shaft 42. The effectiveness of the cooling system is enhanced by the rotation of the target which forces the coolant against the inner surfaces of the target support 54** and thereby facilitates the transfer of heat from the inner surfaces of the target support to the coolant.

It is known in the art that organic vapors within a vacuum environment become carbonized under ion bombardment. This phenomenon may result in the deposit of carbon on the target material which is detrimental to the efficiency of the target, unless the vapor is removed from the system. A hollow ring 93 which is made of substance of high thermal conductivity is provided in close proximity to the target surfaces 56 and 58. The ring 93 is supported by tubes 94 and 95 fabricated from material of low thermal conductivity, which project through conduits 96 and 97, respectively. Tubes 94 and 95 carry a refrigerant such as liquid nitrogen from a source (not shown) to the cavity 98 within ring. The ring is positioned sufficiently close to the target surfaces 56 and 58 so that organic vapors tend to condense on the chilled external surfaces of ring 93 rather than on the target. A secondary effect of the chilled ring 93 is that it aids in cooling the target material on the target support 54 by radiation. Although a ring-shaped geometric figure is used in the embodiment described herein, it is clear that figures of other, closer-fitting geometries, such as a V-shaped figure, which would be symmetric with respect to the target support 54, could be used as well without departing from the scope of the invention described herein.

The shaft 42 is rotatably mounted within the housing 10 by annular bearings 99*a* and 99*b* which are fixed in place by annular bearing supports 100*a* and 100*b*, respectively. Bearing supports 100*a* and 100*b* are fixed in place by threaded screws 101, and ring seals 102, 103, 104 and 106 are provided to retain a vacuum within housing 10.

The shaft 42 is driven by a pulley 108 and belt 110 which is powered by motor or other suitable means not shown. Bolt 112 or other suitable locking means secures the pulley 108 to the shaft 42 such that rotation of the pulley 110 causes rotation of shaft 42.

Both atomic deuterium ions $D^+$ of 2 atomic mass units and molecular deuterium ions $D_2^+$ of 4 atomic mass units are emitted in comparable quantities by ion sources 113 and 115 in ion-producing accelerators (not shown). A suitable accelerator is the Cockroft-Walton accelerator although many others are well known. The combination of atomic and molecular ions pass through a water-cooled aperture plate 121 which defines the width of the beam of ions which enters a uniform magnetic field created by conventional electromagnetic means 114 and 116. The magnetic fields created by magnets 114 and 116 deflect the ions from ion sources 113 and 115, respectively, in accordance with the well known Lorentz force on a charged particle moving in a magnetic field. As used in the description and claims herein, ion source refers to ions that have been generated by an accelerator or other particle generator whereby said ions have been focused into a beam of generally circular cross sectional area whereby said ions are about to be emitted from said accelerator or particle generator without further processing. The atomic ions from source 113 are deflected by magnetic means 114 to target area 58*a* and atomic ions from source 115 by magnetic means 116 to target area 56*a*. The molecular ions are deflected less than the atomic ions and, as a result, strike surfaces 58*b* and 56*b* due to magnetic means 114 and 116, respectively. Thus, each region 56*a*, 56*b*, 58*a* and 58*b* is bombarded by ions of a single mass species which provides for an efficient use of the ions produced by the accelerator.

Electromagnetic means 114 and 116 are energized by well known power supplies 117 and 119, respectively. In the preferred embodiment, magnetic means 114 and 116 each has a wedge-shaped cross section, as shown, which has the effect of increasing the width of the $D^+$ and $D_2^+$ beams. Since the combination $D^+$ and $D_2^+$ beams emitted by the sources 113 and 115 are typically circular, means 114 and 116 spread out and separate the source beams into beams of $D^+$ and $D_2^+$ ions which are substantially rectangular, or in the shape of a flattened oval. By a second method, substantially rectangular beams of single species ions can be made to impinge on target surfaces 56 and 58 by scanning. In the second method, magnetic means 114 and 116 have a rectangular cross section (not shown). Power supplies 117 and 119 provide to means 114 and 116, respectively, a dc current on which an ac current is superimposed. The dc current provides the average value of magnetic field to separate the atomic and molecular species, and the ac current is of such magnitude that it causes both species to be scanned or swept over the target so that each species impinges on a substantially rectangular area of the target without overlapping one on the other. The ac frequency is sufficiently high, compared with the rotational velocity of the target support, so that the rotational movement of the target is negligible during one ac cycle which causes one scan cycle of the ion beams.

The ions produced by sources 113 and 115 of the accelerators proceed in a direction such that they would not strike the target at all if no magnetic field were produced by means 114 and 116. Since the magnetic field applied by means 114 and 116 is only sufficiently strong to deflect the $D_2^+$ molecular ions to the edge of target surfaces 58*b* and 56*b* closest to shaft 42, respectively, any ions heavier than atomic mass 4 miss the target completely.

Neutrons escape the target housing through window 118 whose center is preferably along a radial line from the center of the toroidal support which is contained in the median plane of the targets. Window 118 is a thin-walled section of ring 16 which may be referred to as a means for allowing neutrons to escape housing 10 with a minimum of interference by scatter or absorption. In the application of neutrons for cancer therapy, one end of a conical neutron collimator would be placed just outside housing 10, near the window 118, and the other end of said collimator near the area of the patient's body to be treated, with the axis of said collimator coinciding with the radial line described in the previous sentence. Thus, the target surfaces are elongated in the direction of the patient which is the preferred arrangement for cancer therapy.

OPERATION

In operation, means not shown drive belt 110 which in turn drives pulley 108, thus causing shaft 42 to rotate about its axis. The target support and cooling tube assembly 40 is thus rotated about its axis also. A plurality of accelerators (not shown) direct ions from their sources 113 and 115 of energy of approximately 400 KEV through the magnetic fields of magnets 114 and 116 through flanged ports 24 and 26 so that said ions or other particles impinge approximately perpendicularly on a generally rectangular area of the target material which is deposited on surfaces 56 and 58 of the target support 54 which is rotating. The ion beams from the accelerators are directed so that they impinge on the entire width of targets 56 and 58, and over a height not to exceed 2 cm. The target material emits neutrons generally isotropically which are allowed to traverse the target housing 10 with a minimum loss by scatter or absorption via window 118. Before and during the neutron generating process, coolant is directed through connector 62 and to the interior channel 60 of the target support via shaft channel 70*a* and tube 74. Coolant flows turbulently through channel 60 due to fins 84, thus removing heat from the target support 54 and the target material. The hot coolant then flows out from the target assembly through connector 86 via tube 76 and channel 70*b*.

ALTERNATIVE EMBODIMENTS

In an alternative embodiment, the target can be used with a single ion beam directed to either surface 58 via port 26 or surface 56 via port 24 instead of using two beams simultaneously directed at both surfaces 56 and 58. In this embodiment, the unused target surface can be exposed to an ion beam after the first is spent either by directing ions through the previously unused port or by reversing the target support and cooling assembly 40 and directing ions through the same port at the fresh target.

Figure 5:
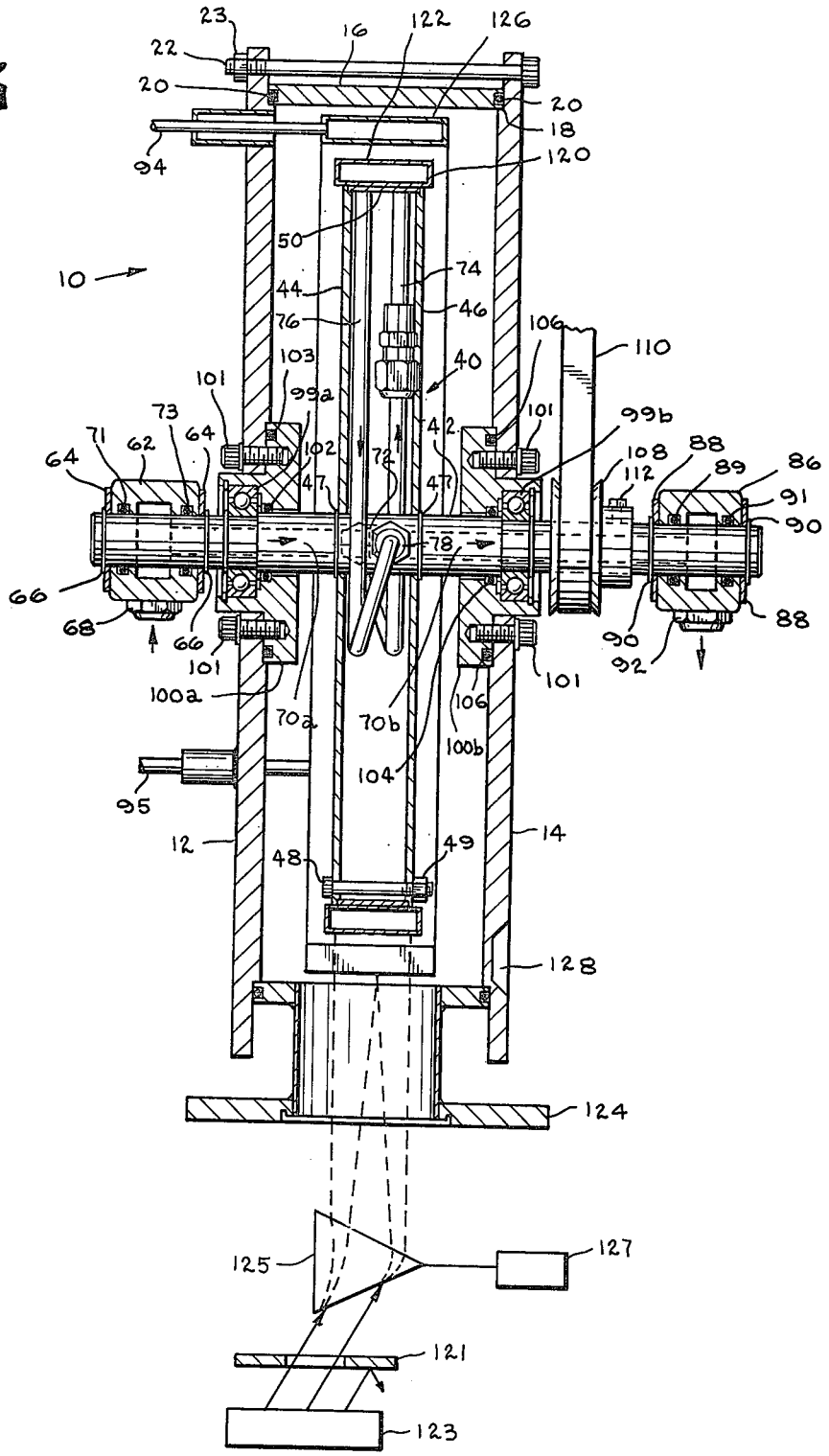
FIG. 5 is a partial sectional view of an alternative embodiment of the target apparatus.

Another alternative embodiment, shown in FIG. 5, is substantially the same as the target apparatus of FIGS. 1–4. In the alternative embodiment among other departures from the preferred embodiment, a toroidal target of rectangular cross section (the external surface has the form of a cylinder) is implemented in place of the isosceles toroid of FIG. 1, the positions of one ion entry port (and accelerator) and the neutron emission window are interchanged, and the single target surface has the form corresponding to a frustum of zero cone angle. In this embodiment, provision is made for the use of only one accelerator.

More particularly, the rectangular toroidal target support 120 has deposited on external surface 122 thereof a layer of tritiated titanium or other neutron emissive substance. A single flanged port 124 is provided for attachment to an ion accelerator (not shown) through which ions from the ion source 123 within the accelerator may pass, after said ions pass through a uniform magnetic field caused by electromagnetic means 125. Magnetic means 125 is supplied with power from supply 127. The refrigerated ring 126 of the embodiment differs from the ring 93 of FIG. 1 in that a section thereof is removed and sealed so that ions from the ion source 123 of the accelerator can pass through flanged port 124 to target support 120 without interference as shown in FIG. 5. Neutrons are emitted generally isotropically from target material on the rotating toroid 120 of rectangular cross section and are allowed to escape the target apparatus through window 128 which is sufficiently thin so as not to appreciably absorb or scatter said neutrons. In all other respects, the target apparatus of FIG. 5 is identical in structure and function to the apparatus of FIG. 1.

Thus, a neutron generator target apparatus has been described which can produce a high flux of neutrons by bombarding two surfaces of a rotating target with ions from two ion sources. Further, the geometry of the neutron source is such that a well-collimated beam of neutrons may be formed. Further, since a rate of neutrons in excess of approximately 4 times $10^{12}$ neutrons per second can be produced by the apparatus described herein, this apparatus can be used for cancer therapy which requires such a high neutron intensity. By means of a suitable collimator, a beam of neutrons can safely be directed to a specified area of a patient's body for treatment of cancer or other applications.

Further, a neutron generator target apparatus has been described which effectively spreads an ion beam over a large area of rotating target to prevent overheating and dilution of the target while creating a high intensity of neutrons.

Also, a cooling system has been described which efficiently prevents the target material from overheating, thus preventing degradation of the neutron emissive property of the target.

Also, an apparatus and method have been shown for efficiently using both the atomic and molecular ions produced by an ion source for target bombardment by separating by magnetic means the combination of such ions such that only ions of single mass species impinge on defined areas of the target.

The foregoing disclosure and description of the invention are illustrative and explanatory thereof and various changes in size, shape and materials as well as in details of the illustrated construction may be made without departing from the scope of the invention.

What is claimed is:

1. An apparatus for generating neutrons comprising:

a. a toroidal target support, said support mounted for rotational movement about the axis of the toroid, said support having a first external surface thereon extending generally around the perimeter of said support, said first surface having deposited thereon a first neutron emissive target;

b. a first source of ions, said first source directing ions to said first surface as the toroidal support rotates such that ions are spread over and impinge on said first target;

c. a second external surface on said support extending generally around the perimeter of said support, said second surface having deposited thereon a second neutron emissive target, including:

a second source of ions, said second source directing ions to said second surface as the toroidal support rotates such that ions from said first and second sources are spread over and impinge on said first and second surfaces, respectively;

whereby the ions impinge on the targets on said first and second surfaces causing high energy neutrons to be emitted.

2. An apparatus for generating neutrons comprising:

a. a toroidal target support, said support mounted for rotational movement about the axis of the toroid, said support having an external surface thereon extending generally around the perimeter of said support, said surface having deposited thereon a neutron emissive target;

b. a source of ions, said source directing ions to said surface as the toroidal support rotates such that ions are spread over and impinge on said target; and c. a magnetic means, said magnetic means creating a magnetic field, whereby the ions from said source are passed through said magnetic field such that ions of different mass species are substantially separated before said ions impinge on said target.

3. The apparatus of claim 2 wherein said magnetic means spreads out said ions whereby the area of said target bombarded by said ions is substantially rectangular.

4. The apparatus of claim 3 for cancer therapy wherein said neutron-emissive target is elongated in the direction of the axis of a collimator, whereby an improved source of neutrons is provided for cancer therapy.

5. The apparatus of claim 4 wherein the area of said target which is bombarded by said ions projected on a plane perpendicular to the axis of said collimation does not exceed 2 centimeters by 2 centimeters.

6. The apparatus of claim 1 including:

a. a first magnetic means, said first magnetic means creating a magnetic field in the path of the ions between said first source and said first surface, said ions from said first source being passed through said magnetic field causing ions of different mass species to separate before said ions impinge on said target on said first surface; and b. a second magnetic means, said second magnetic means creating a magnetic field in the path of said ions between said second source and said second surface, said ions from said second source being passed through said field created by said second magnetic means causing ions of different mass species to separate before said ions impinge on said target on said second surface.

7. The apparatus of claim 1 wherein the toroidal target support is made of a high thermal conductivity material and has a hollow cavity therein, such that coolant may flow circumferentially through said target support for the purpose of cooling said support and said target material.

8. The apparatus of claim 7 wherein said target material is tritiated titanium and said ions are atomic and molecular deuterium ions.

9. The apparatus of claim 8 including a member placed in close proximity to said toroidal target support, said member having a hollow cavity therein for containing a refrigerant, said refrigerant cooling said member whereby said member condenses vapors thereon which are near the target and which also cools the target material.

10. The apparatus of claim 6 wherein said toroidal target support is made of a high thermal conductivity material and has a hollow cavity therein such that coolant may flow circumferentially through said support for the purpose of cooling said support and said target.

11. The apparatus of claim 10 including a member placed in close proximity to said toroidal target support, said member having a hollow cavity therein for containing a refrigerant, said refrigerant cooling said member, whereby said chilled member causes vapors to condense thereon and absorbs heat from said target.

12. The apparatus of claim 6 wherein said target material is tritiated titanium and said ions are atomic and molecular deuterium ions.

13. The apparatus of claim 6 wherein said first and second magnetic means spreads out said ions whereby the areas on said first and second target bombarded by said ions are substantially rectangular.

14. The apparatus of claim 13 for cancer therapy wherein said first and second neutron-emissive targets are elongated in the direction of the axis of a collimator, whereby an improved source of neutrons is provided for cancer therapy.

15. The apparatus of claim 14 wherein the areas of said first and second targets which are bombarded by said ions, projected on a plane perpendicular to the axis of said collimation, together do not exceed 2 centimeters by 2 centimeters.

16. The apparatus of claim 7 including:

a. a housing for said target support, said housing enclosing said support and capable of sustaining a vacuum therein; and b. means for allowing neutrons to escape said housing with minimum interference by scattering or absorption.

17. A method of separating a beam of ions of several mass species into separate beams of ions of single mass species, said beam of ions being emitted from an ion source for the purpose of bombarding a neutron-emissive target to produce neutrons, comprising the steps of:

a. causing a source of ions to emit ions of different mass species toward a neutron-emissive target; and b. passing said ions through a magnetic field after emission from said source, said magnetic field causing said ions to be deflected according to the Lorentz force on said ions;

whereby said ions are separated into beams of ions of single mass species before said ions impinge on said target.

18. The method of claim 17 including:

causing said magnetic field to increase the width of the beams of said ions of single mass species, whereby impinging beams of ions of single mass species are provided that have greater width than height.

19. A method of cooling a toroidal neutron generator, said neutron generator having a toroidal target support mounted on a coaxial shaft, said support having a hollow channel circumferentially through the interior of said support, said support channel having interior surfaces, said shaft rotatable about its longitudinal axis, said support having a neutron-emissive target externally thereon, said shaft having a longitudinal coaxial cavity therein for passing a coolant, said cavity having a partition therein for dividing said cavity into input and output subcavities, said input cavities passing coolant to said channel of said support, said output cavity passing coolant from said support, said neutron generator having first communicating means between said input cavity and said support channel for passing coolant from said input cavity to said support channel, said neutron generator having second communicating means between said support channel and said output cavity for passing coolant to said output cavity from said support channel, said support channel having means for controlling the flow of coolant therein, said control means directing coolant through said channel for not more than one revolution, comprising the steps of:

a. causing coolant to flow through said input cavity of said shaft, from said input cavity through said first communication means, from said first communication means to said support channel, and from said channel after said coolant has traveled no more than one revolution therethrough to said output cavity, whereby coolant travels circumferentially through said support and removes heat from the interior surfaces of said support.

20. The method of claim 19 including the step of causing coolant to flow turbulently through said support channel whereby trapping and stagnation of coolant is minimized.

21. An apparatus for cooling a rotating particle generator, comprising:

a. a housing, said housing forming an enclosure for a target apparatus;

b. a shaft, said shaft rotatably mounted within said housing, said shaft having both ends extruding externally from said housing, said shaft having a hollow channel along the longitudinal axis thereof for transmitting coolant axially therein;

c. a toroidal target support, said support mounted securely on said shaft, said support having a channel circumferentially through the interior of said support, said support channel having interior surfaces therein, said channel adapted to retain coolant therein, said support having target thereon externally such that bombardment of said target causes particles to be emitted therefrom, d. means for dividing said shaft channel into an input cavity and an output cavity, e. a first means for transmitting coolant from said input cavity to said support channel;

f. a second means for transmitting coolant from said support channel to said output cavity;

g. means for controlling the flow of coolant through said support channel such that coolant travels circumferentially through said support channel for no more than one revolution and then out from said support into said second transmitting means and whereby coolant which flows into said input cavity of said shaft channel is directed by said dividing means into said first transmitting means and into said support channel, and directed circumferentially through said support following the shape of said toroid, and directed by said control means after coolant has made no more than one revolution through said toroid into said second transmitting means, and from said second transmitting means to said output cavity means of said shaft, thus removing heat from the interior surfaces of said support.

22. The apparatus of claim 21 including means for causing coolant to flow turbulently through the support channel to prevent trapping or stagnation of said coolant.

23. An apparatus for generating neutrons comprising:

a. a toroidal target support, said support mounted for rotational movement about the axis of the toroid, said support having a first external surface thereon extending generally around the perimeter of said support, said first surface having deposited thereon a first neutron emissive target; and b. a second external surface on said target extending generally around the perimeter of said support, said second surface having deposited thereon a second neutron emissive target; and c. a source of ions, said source directing ions to one of said first or second surfaces as the toroidal support rotates such that ions are spread over and impinge on the target on such surface;

whereby the ions impinging on the targets on either of said first or second surfaces cause high energy neutrons to be emitted.

24. An apparatus for generating neutrons comprising:

a. a target support having a surface, said surface having deposited thereon a neutron emissive target;

b. a source of ions of different mass species, said source directing ions to said target; and c. a magnetic means, said magnetic means creating a magnetic field in the path of said ions between said ion source and said target;

whereby the ions from said ion source are passed through said magnetic field such that said ions are separated into groups of ions of single mass species before said ions impinge on said target.

25. Apparatus for generating neutrons with a source beam containing atomic and diatomic molecular deuterium ions, said apparatus being characterized by:

a target including material which emits neutrons when bombarded with atomic and diatomic molecular deuterium ions;

means for separating said source beam into a first beam containing substantially only atomic deuterium ions and a second beam containing substantially only diatomic deuterium ions; and means for directing said first and second beams onto said target such that each beam strikes said target at a different location.

26. The apparatus according to claim 25 wherein said target material is tritium absorbed in titanium.

27. The apparatus according to claim 25 wherein said means for separating includes means for deflecting said source beam to vary the locations at which said plural beams strike said target.

28. In a neutron generator of the type wherein ions of different mass in a source beam impinge upon a target and the ions of each mass penetrate said target to a different depth, the method of preventing ions of one mass from impairing the neutron generation capability at said target of ions of other masses, said method comprising the steps of:

separating said source beam into plural beams each containing substantially only ions having a respective mass; and directing all of said plural beams onto said target at different locations.

29. The method according to claim 28 further including the step of deflecting said source beam to vary the locations at which said plural beams strike said target.

* * * * *